US009938047B2

(12) United States Patent
Batarseh

(10) Patent No.: US 9,938,047 B2
(45) Date of Patent: Apr. 10, 2018

(54) RESEALABLE STORAGE BAG

(71) Applicant: Esther Khawaja Batarseh, Sugar Land, TX (US)

(72) Inventor: Esther Khawaja Batarseh, Sugar Land, TX (US)

( * ) Notice: Subject to any disclaimer, the term of this patent is extended or adjusted under 35 U.S.C. 154(b) by 653 days.

(21) Appl. No.: 13/936,609

(22) Filed: Jul. 8, 2013

(65) Prior Publication Data

US 2015/0016753 A1 Jan. 15, 2015

(51) Int. Cl.
*B65D 33/00* (2006.01)
*B65D 33/25* (2006.01)
*B65D 30/10* (2006.01)

(52) U.S. Cl.
CPC ..... *B65D 33/2591* (2013.01); *B65D 31/16* (2013.01)

(58) Field of Classification Search
CPC ..... B65D 33/25; B65D 33/2533; B65D 33/2541; B65D 33/2591; B65D 33/2508; B65D 33/255; A44B 19/16; A44B 19/267; B31B 19/90; B31B 2219/9019
USPC ..... 383/61.2, 61.3, 63, 64
See application file for complete search history.

(56) References Cited

U.S. PATENT DOCUMENTS 3,478,952 A * 11/1969 Perlman ..... 206/521
3,516,537 A * 6/1970 Griffiths et al. ..... 206/497
3,558,406 A * 1/1971 Kugler ..... B31B 70/00 156/251
6,022,144 A * 2/2000 Hausslein ..... 383/33
6,164,821 A * 12/2000 Randall ..... 383/34
6,270,819 B1 * 8/2001 Wiese ..... 426/129
6,290,392 B1 * 9/2001 Sandor ..... 383/33
6,345,911 B1 * 2/2002 Young et al. ..... 383/6
6,508,587 B1 * 1/2003 Byers, Jr. ..... 383/33
6,641,307 B2 * 11/2003 Matsuda et al. ..... 383/38
7,347,623 B2 * 3/2008 Cawley ..... 383/33
D639,004 S * 5/2011 Dunn et al. ..... D32/37
8,678,650 B2 * 3/2014 Savage ..... 383/33
2003/0077007 A1 * 4/2003 Turvey et al. ..... 383/33
2004/0114838 A1 * 6/2004 McGregor ..... 383/204
2007/0047851 A1 * 3/2007 Sato et al. ..... 383/104
2007/0258663 A1 * 11/2007 Plourde et al. ..... 383/9
2008/0292225 A1 * 11/2008 Dayrit et al. ..... 383/207
2009/0056281 A1 * 3/2009 Murray ..... 53/455
2010/0278457 A1 * 11/2010 Greco et al. ..... 383/64
2011/0044566 A1 * 2/2011 Fish et al. ..... 383/63
2011/0049138 A1 * 3/2011 Korczak ..... 220/2
2013/0016925 A1 * 1/2013 Murray ..... 383/109
2013/0028539 A1 * 1/2013 Vonwiller ..... 383/64
2013/0343678 A1 * 12/2013 Burggren ..... 383/64

* cited by examiner

*Primary Examiner* — Peter Helvey
(74) *Attorney, Agent, or Firm* — Benjamin Aaron Adler

(57) ABSTRACT

Provided herein are storage bags having an opening to an interior thereof formed by pliable front and back panels each comprising outwardly curved upper portions and rectangular lower portions having first and second straight side edges, straight bottom edges and outwardly curved top edges that are sealed together along respective side and bottom edges and means for sealing and opening the bag. The storage bag may comprise first and second seamed edges that are equal in length with the outwardly curved top edges extending therefrom. Alternatively, the storage bag may comprise a first seamed edge that is shorter than the second seamed edge with the outwardly curved top edges extending therefrom.

10 Claims, 5 Drawing Sheets

RESEALABLE STORAGE BAG

BACKGROUND OF THE INVENTION

Field of the Invention

The present invention relates generally to the fields of resealable storage bags. Specifically, the present invention relates to resealable storage bags with features for improved loading and removing of items, for example, foodstuffs.

Description of the Related Art

Storage bags, particularly for food, are well known. Generally, the bags are a pliable plastic manufactured as a rectangular shape with an open end sealable by manual or mechanical means, such as a zipper-like mechanism. Although pliable, the opening to standard plastic storage bags is limited or constrained at the juncture of the seams and the sealing means, particularly, if a mechanical means is utilized to seal the bag. Such a configuration reduces the diameter of the mouth of the storage bag so that frequently a larger bag than necessary must be used to contain an item. Moreover, to load these storage bags, a user must simultaneously keep the bag open with one hand while loading the bag with the other.

Thus, there is a recognized need for storage bags that will open easily and will stay open while loading. Specifically, the prior art is deficient in storage bags which comprise outwardly curved resealable upper ends that are foldable back over the front and back of the storage bag. The present invention fulfills this longstanding need and desire in the art.

SUMMARY OF THE INVENTION

The present invention is directed to a resealable storage bag. The resealable storage bag comprises an opening to an interior thereof formed by pliable front and back panels each having first and second straight side edges, straight bottom edges and outwardly curved top edges. The front and back panels are sealed together along respective side and bottom edges. The resealable storage bag comprises means for sealing and opening the bag.

The present invention also is directed to a resealable food storage bag. The resealable food storage bag comprises a pliable bag body having front lower and upper portions and back lower and upper portions, where the lower portions each have first and second side edges of equal length and bottom edges of equal length such that the lower portions are sealed together along respective first and second side and bottom edges and where the upper portions comprise first and second outwardly curving top edges. The resealable food storage bag comprises a closure member having an engaging component disposed continuously along the first outwardly curving top edge and a receiving component disposed continuously along the second outwardly curving top edge.

The present invention is directed further to another resealable food storage bag. The resealable food storage bag comprises a pliable bag body having front lower and upper portions and back lower and upper portions where the lower portions each have first side edges of equal length and second side edges of equal but longer length than the first side edges and bottom edges of equal length such that the lower portions are sealed together along respective first and second side and bottom edges and where the upper portions comprise first and second outwardly curving top edges. The resealable food storage bag comprises a closure member as described herein.

Other and further aspects, features, and advantages of the present invention will be apparent from the following description of the presently preferred embodiments of the invention. These embodiments are given for the purpose of disclosure.

BRIEF DESCRIPTION OF THE DRAWINGS

So that the matter in which the above-recited features, advantages and objects of the invention, as well as others which will become clear, are attained and can be understood in detail, more particular descriptions and certain embodiments of the invention briefly summarized above are illustrated in the appended drawings. These drawings form a part of the specification. It is to be noted, however, that the appended drawings illustrate preferred embodiments of the invention and therefore are not to be considered limiting in their scope.

DETAILED DESCRIPTION OF THE INVENTION

Figure 1:
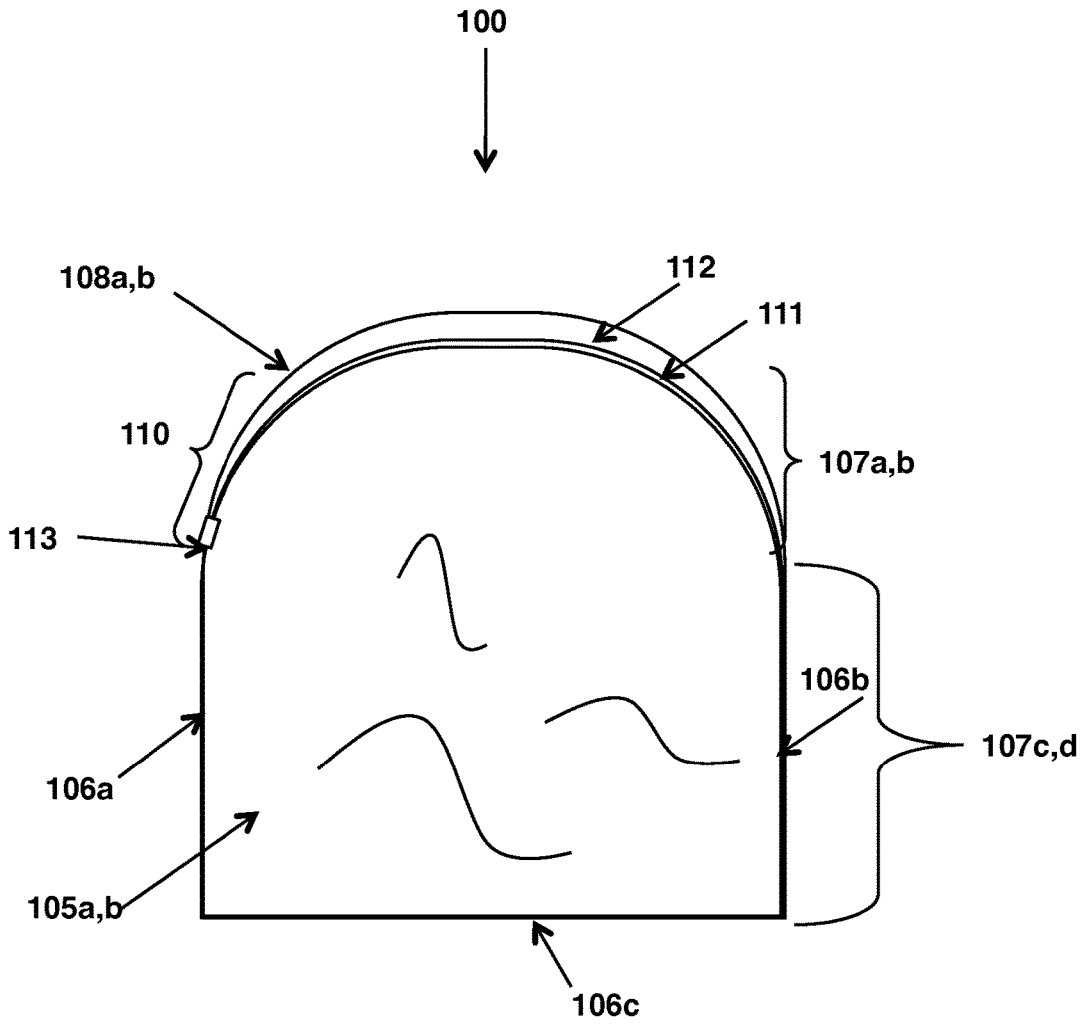
FIG. 1 depicts a front view of the resealable storage bag in a closed or zipped configuration.

As used herein, the term, "a" or "an" may mean one or more. As used herein in the claim(s), when used in conjunction with the word "comprising", the words "a" or "an" may mean one or more than one. As used herein "another" or "other" may mean at least a second or more of the same or different claim element or components thereof. The terms "comprise" and "comprising" are used in the inclusive, open sense, meaning that additional elements may be included.

As used herein, the term "or" in the claims refers to "and/or" unless explicitly indicated to refer to alternatives only or the alternatives are mutually exclusive, although the disclosure supports a definition that refers to only alternatives and "and/or".

As used herein, the term "about" refers to a numeric value, including, for example, whole numbers, fractions, and percentages, whether or not explicitly indicated. The term "about" generally refers to a range of numerical values (e.g., +/−5-10% of the recited value) that one of ordinary skill in the art would consider equivalent to the recited value (e.g., having the same function or result). In some instances, the term "about" may include numerical values that are rounded to the nearest significant figure.

As used herein, the term "foodstuff" refers to any substance that is or can be used or prepared for use as food.

In one embodiment of the present invention there is provided a resealable storage bag, comprising a bag having an opening to an interior thereof formed by pliable front and back panels each having first and second straight side edges, straight bottom edges and outwardly curved top edges, the front and back panels sealed together along respective side and bottom edges; and means for sealing and opening the bag.

In one aspect of this embodiment the first side edges each may have lengths equal to lengths of the second side edges and may form first and second seams equal in length. In another aspect the first side edges each may have lengths shorter than lengths of the second side edges and may form a first seam shorter in length than a second seam.

In this embodiment the outwardly curved top edges may comprise upper portions of the front and back panels, where the upper portions independently are foldable back over the respective front and back panels when the bag is open. Particularly, the foldable front and back panels form an opening for easier insertion of foodstuffs.

Also in this embodiment the means for sealing and opening the bag may comprise a closure member having a male profile disposed continuously along the outwardly curved top edge of the front panel and a female profile disposed continuously along the outwardly curved top edge of the back panel, where the bag is sealed as the male profile is engaged with the female profile in one direction and is opened as the male profile is disengaged from the female profile in the other direction. Particularly, the closure member may be disposed on inner surfaces of the front and back panels immediately below the outwardly curving top edge. As a representative example, the closure member may be a zipper comprising zipper profiles disposed continuously along the outwardly curved top edges and a slider clip disposed on the zipper profiles, where the bag is sealed as the slider clip couples the zipper profiles in one direction and the bag is opened as the slider clip decouples the zipper profiles in the other direction.

In another embodiment of the present invention there is provided a resealable food storage bag, comprising a pliable bag body having front lower and upper portions and back lower and upper portions, the lower portions each having first and second side edges of equal length and bottom edges of equal length such that the lower portions are sealed together along respective first and second side and bottom edges, the upper portions comprising first and second outwardly curving top edges; and a closure member comprising an engaging component disposed continuously along the first outwardly curving top edge and a receiving component disposed continuously along the second outwardly curving top edge.

In this embodiment the upper portions of the pliable bag body may be independently foldable back over the respective front and back lower portions when the pliable bag body is open. Particularly the foldable upper portions form an opening for easier insertion of foodstuffs. Representative foodstuffs comprise pies, casseroles or other foodstuffs that must remain level for loading into the storage bag and for storage.

Also in this embodiment the pliable bag body is sealed as the engaging component engages the receiving component in one direction and is opened as the engaging component disengages the receiving component in the other direction. Particularly, the closure member may be disposed on inner surfaces of the front and back panels immediately below the outwardly curving top edge. In a representative example the engaging component and the receiving component are zipper profiles disposed continuously along the outwardly curved top edges, where the zipper profiles coupled with a slider clip disposed thereon such that the bag is sealed as the slider clip couples the zipper profiles in one direction and the bag is opened as the slider clip decouples the zipper profiles in the other direction.

In yet another embodiment of the present invention there is provided a resealable food storage bag, comprising a pliable bag body having front lower and upper portions and back lower and upper portions, the lower portions each having first side edges of equal length and second side edges of equal but longer length than the first side edges and bottom edges of equal length such that the lower portions are sealed together along respective first and second side and bottom edges, the upper portions comprising first and second outwardly curving top edges; and a closure member comprising an engaging component disposed continuously along the first outwardly curving top edge and a receiving component disposed continuously along the second outwardly curving top edge.

In this embodiment the upper portions of the pliable bag body independently may be foldable back over the respective front and back lower portions toward the second side edges when the pliable bag body is open. Particularly, the foldable upper portions may form an opening for easier insertion of foodstuffs. Also, the pliable bag may be sealed and opened as described supra and the closure member may comprise those components, for example a zipper and slider clip, and may be disposed on the pliable bag be as described supra.

Provided herein is a storage bag having easy access for foodstuffs or other storable items. Generally, the storage bag has outwardly curving top or upper front and back portions or panels extending from straight lower front and back seamed portions. This enables one or both of the curved upper portions to fold back over the lower bag areas for increased ease of insertion of the foodstuffs or other items of interest therein. Thus the effective diameter across the insertion area or mouth of the bag is not confined, shortened or encumbered by the seamed square corners or any mechanical means of closure, if present, of a standard storage bag, as is known in the art.

In one configuration, the storage bag has first and second side seams of equal length. That is, the side seams are formed from respective first front and back side edges of equal length and second front and back side edges of equal length. In another configuration, the storage bag has side seams of unequal length. That is, the first front and back side edges are of equal length, the second front and back side edges are of equal length, but are longer than the first side edges. The seam along the second side of the bag extends further up the bag than does the first seam. This provides a bag mouth of a greater diameter without having to increase the bag width to accommodate the same foodstuff or other items. This configuration enables easy insertion of bulky or cumbersome foodstuffs, such as, but not limited to, pies, casseroles, sub sandwiches, or other foodstuffs that must be inserted into the storage bag and stored without upending or foodstuffs such as loaves of bread, flat breads, matzos, or pitas, etc.

The length of the side seams are not limited. For example, embodiments of the storage bag include those without one or both of the side edges or side seams or with one or both side seams only of a minimum length sufficient to accommodate, for example, those components of a closing means or closure member, such as a slider clip, in an open and closed configuration. In these embodiments the outwardly curving top or upper front and back portions or panels depend directly from or effectively from the bottom seamed edge.

The storage bags comprise a resealable means for sealing and unsealing the same. Such means may comprise a closure member having, for example, but not limited to, engaging and receiving components, such as a male profile and a corresponding female profile or Velcro strips disposed along the top edges or on the inner surfaces of the upper front and back bag portions or panels proximate to the top edges. As the engaging and receiving components are engaged in one direction, the storage bag is sealed or closed and as the engaged components are disengaged in the other direction, the bag is unsealed or opened. Engagement can be accomplished manually by running ones fingers across the components to seal the bag or pulling the engaged components apart to unseal the bag. Alternatively, the closure member may comprise a slider clip that engages and disengages the components as it is moved back and forth across the bag. In one nonlimiting example the closure member may comprise zipper profiles and a slider clip as is known and standard in the art.

The storage bags provided herein are made of plastics, for example, a polyethylene, or of a cloth material or fabric, such as, but not limited to, natural or organic cotton, nylon, rip-stop nylon, or polyurethane-coated nylon, as is known and standard in the art, and are manufactured by conventional means. The storage bags may have a variety of volumes to receive and accommodate the foodstuffs or other non-foodstuff items. Standard representative volumes range through pint, quart, half-gallon, gallon, or larger sizes or their metric equivalents.

As described below, the invention provides a number of advantages and uses, however such advantages and uses are not limited by such description. Embodiments of the present invention are better illustrated with reference to the Figure(s), however, such reference is not meant to limit the present invention in any fashion. The embodiments and variations described in detail herein are to be interpreted by the appended claims and equivalents thereof.

FIG. 1 shows one embodiment of a storage bag. In a front view the storage bag 100 comprises pliable front panel 105*a* and back panel 105*b* (see FIG. 2) with first 106*a* and second 106*b* seamed side edges and seamed bottom 106*c* edges. The front and back panels comprise outwardly curved front and back upper 107*a,b* and angular lower 107*c,d* portions. Outwardly curving top edges 108*a,b* comprise a closure member 110 with male 111 and female 112 profiles (see FIGS. 2-3) and a slider clip 113.

Figure 2:
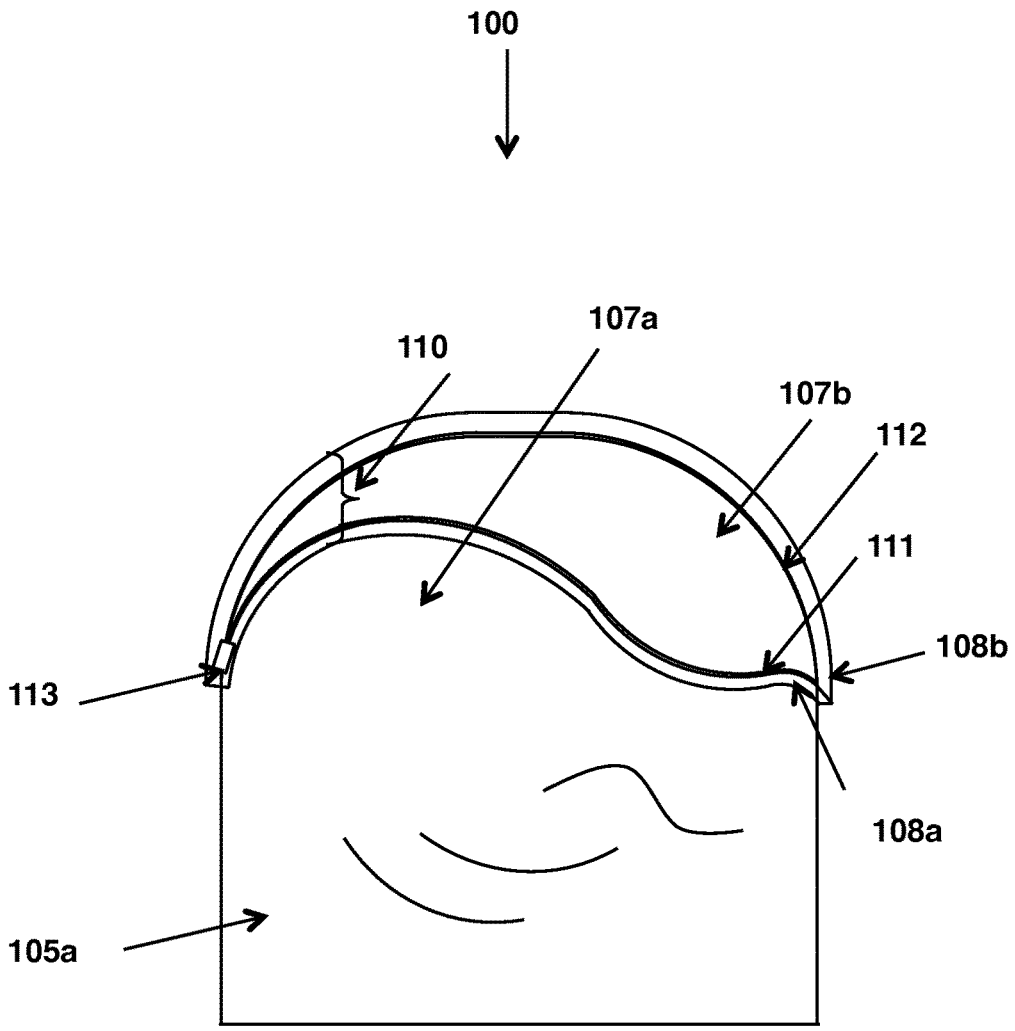
FIG. 2 depicts the storage bag of FIG. 1 in an open or unzipped configuration.

With continued reference to FIG. 1, FIG. 2 shows the storage bag 100 in a perspective top and front view. The storage bag 100 is shown with the front and back panels 105*a,b* pulled apart to better illustrate the closure member 110. The slider clip 113 is shown in an open configuration and the pliability of the outwardly curved front and back upper 107*a,b* portions is demonstrated. The male 111 and female 112 profiles are disposed along and proximate to or immediately below the respective top edges 108*a,b*.

Figure 3:
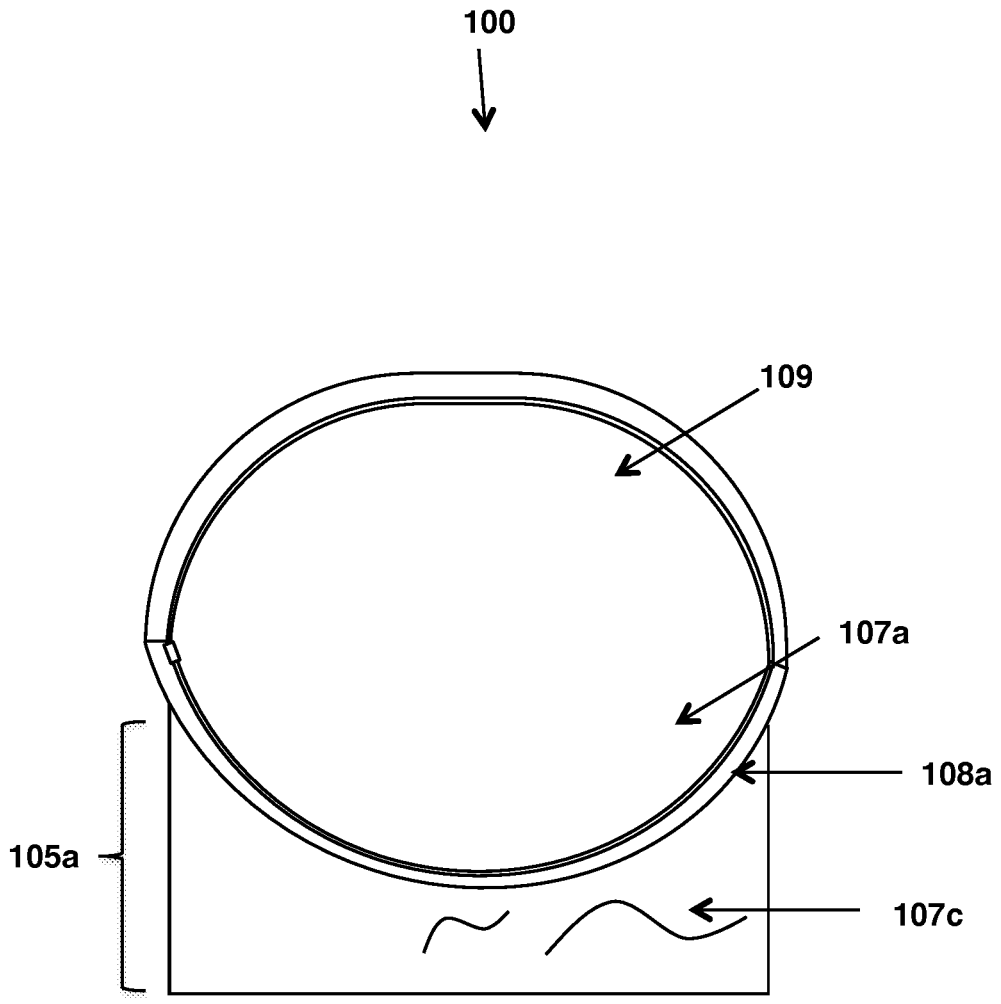
FIG. 3 depicts the resealable storage bag of FIG. 1 with the outwardly curved upper portion folded back over the bag.

With continued reference to FIGS. 1-2, FIG. 3 shows the storage bag 100 in a completely open configuration. The storage bag 100 is shown with the upper front portion 107*a* folded bag over the front lower portion 107*c*. The top edge 108*a* rests against the front surface of the panel 105*a* to form the mouth 109.

Figure 4:
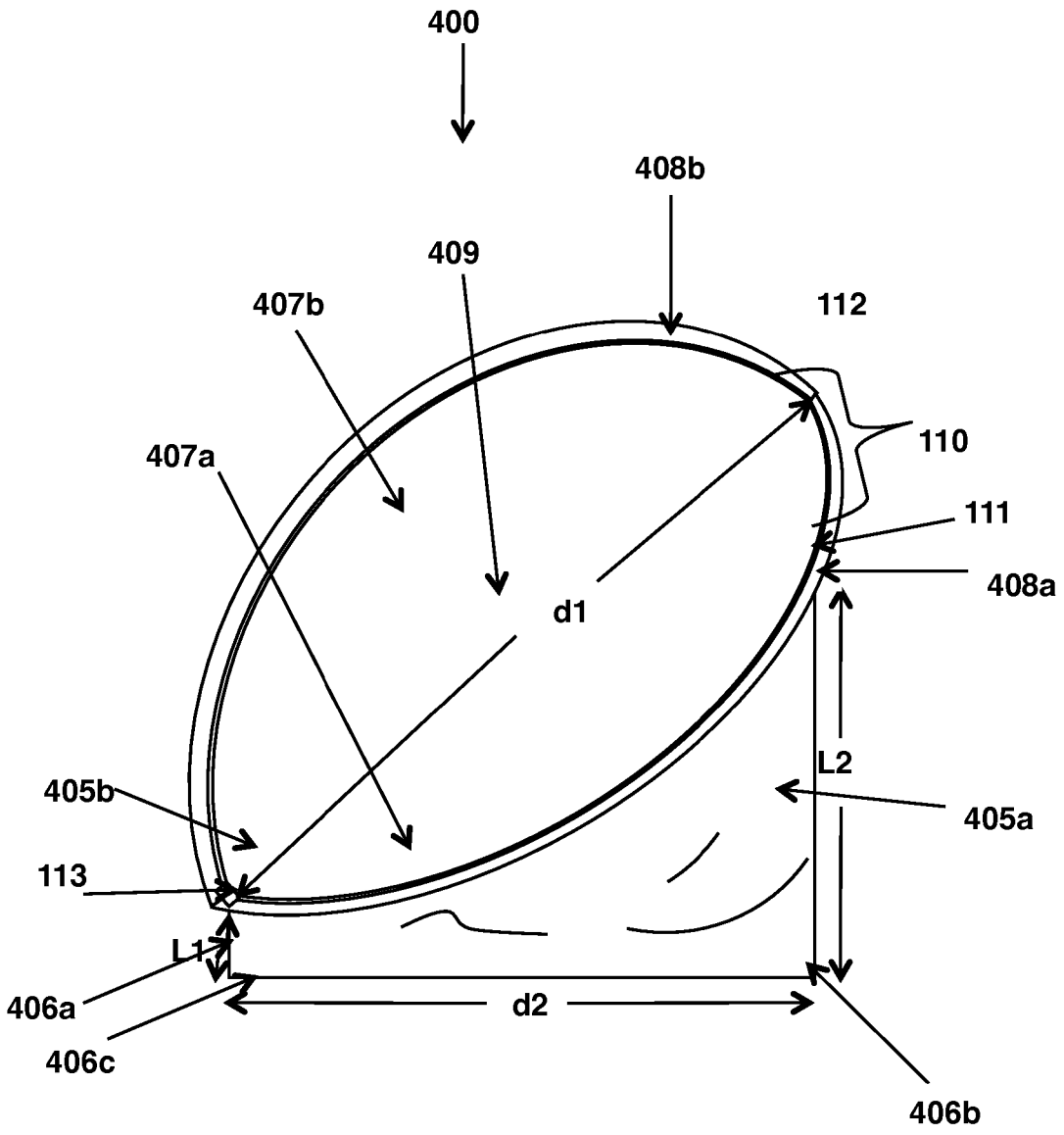
FIG. 4 depicts a resealable food storage bag with the upper outwardly curved portion folded back over the bag.

With continued reference to FIGS. 1 and 3, FIG. 4 shows another embodiment of a storage bag. In a top and front view and substantially corresponding to the pliable storage bag of FIG. 2, the food storage bag 400 comprises pliable front and back panels 405*a,b* where the diameter d1 of the mouth 409 is increased over the width d2 of the storage bag. The storage bag 400 comprises first 406*a* and second 406*b* seamed side edges and seamed bottom 406*c* edges. The first seamed edges have a length L1 shorter than the length L2 of the second seamed edges. The lengths L1 and L2 are not limited in dimension and encompass storage bags where one or both of L1 and L2 are effectively zero or of only such minimal length as to accommodate the slider clip 113 on the closure member 110. The front and back panels comprise outwardly curved front and back upper 407*a,b* and angular lower 407*c,d* portions. Outwardly curving top edges 408*a,b* comprise a closure member 110 with male 111 and female 112 profiles (see FIGS. 2-3) and a slider clip 113.

Figure 5:
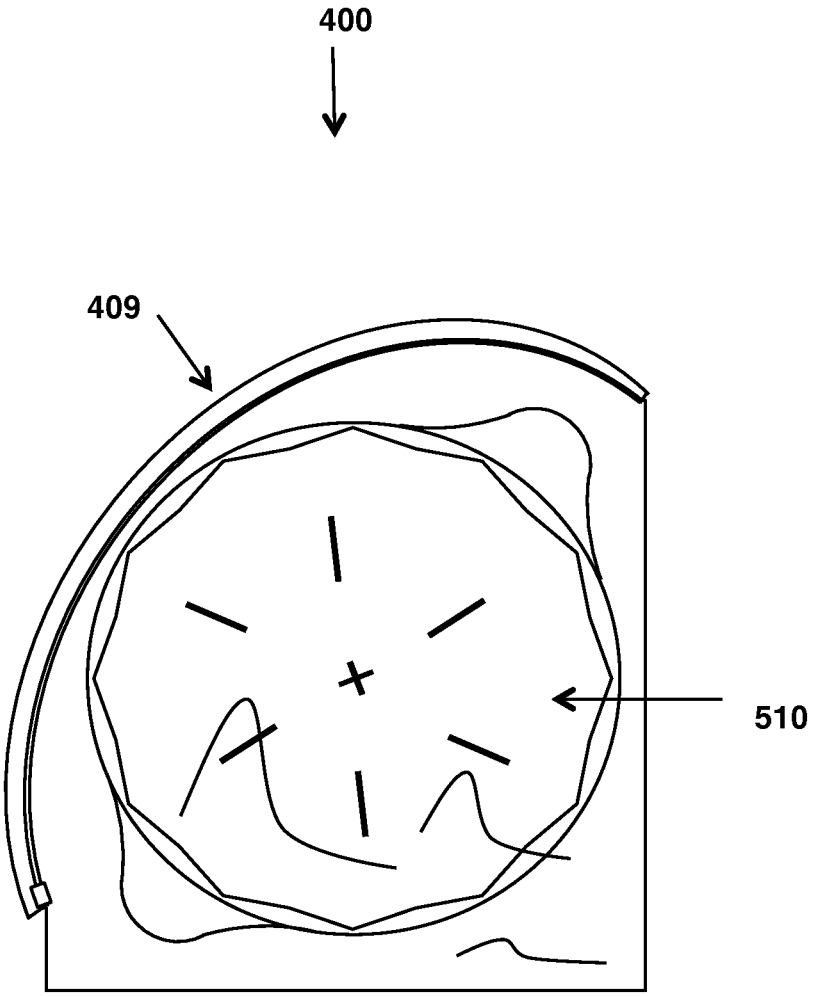
FIG. 5 illustrates storing a pie in the resealable food storage bag of FIG. 4.

With continued reference to FIG. 4, FIG. 5 illustrates a pie 510 sealed within the food storage bag 400. The diameter of the mouth 409 is large enough to accommodate the pie without having to utilize a larger storage bag. The pie would not have fit into a standard rectangular storage bag.

The present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed:

1. A resealable storage bag, comprising:

a bag having an opening to an interior thereof formed by pliable front and back panels each having first and second straight side edges, straight bottom edges and outwardly curved top edges and upper portions independently foldable back over the respective front and back panels, said first side edges having a minimal length such that a diameter across a mouth of the bag is increased over a width of the bag at the straight bottom edges, said front and back panels sealed together along respective side and bottom edges; and means for sealing and opening said bag.

2. The resealable storage bag of claim 1, wherein said foldable front and back panels form an opening for easier insertion of foodstuffs.

3. The resealable storage bag of claim 1, wherein the means for sealing and opening the bag comprises a closure member having a male profile disposed continuously along the outwardly curved top edge of the front panel and a female profile disposed continuously along the outwardly curved top edge of the back panel, said bag sealed as the male profile is engaged with the female profile in one direction and opened as the male profile is disengaged from the female profile in the other direction.

4. The resealable storage bag of claim 3, wherein the closure member is a zipper comprising zipper profiles disposed continuously along the outwardly curved top edges and a slider clip disposed on the zipper profiles, said bag sealed as the slider clip couples the zipper profiles in one direction and said bag opened as the slider clip decouples the zipper profiles in the other direction.

5. The resealable storage bag of claim 3, wherein the closure member is disposed on inner surfaces of the front and back panels immediately below the outwardly curving top edge.

6. A resealable food storage bag, comprising a pliable bag body having front lower and upper portions and back lower and upper portions, said lower portions each having first side edges of minimal equal length and second side edges of equal but longer length than said first side edges and bottom edges of equal length such that the lower portions are sealed together along respective first and second side and bottom edges, said upper portions comprising first and second outwardly curving top edges forming an opening with a diameter increased over a width of the bag at the bottom edges and independently foldable back over the respective front and back lower portions toward said second side edges; and a closure member comprising an engaging component disposed continuously along the first outwardly curving top edge and a receiving component disposed continuously along the second outwardly curving top edge.

7. The resealable storage bag of claim 6, wherein said foldable upper portions form an opening for easier insertion of foodstuffs.

8. The resealable storage bag of claim 6, wherein said pliable bag body is sealed as the engaging component engages the receiving component in one direction and is opened as the engaging component disengages the receiving component in the other direction.

9. The resealable storage bag of claim 6, wherein the engaging component and the receiving component are zipper profiles disposed continuously along the outwardly curved top edges, said zipper profiles coupled with a slider clip disposed thereon such that the bag is sealed as the slider clip couples the zipper profiles in one direction and the bag is opened as the slider clip decouples the zipper profiles in the other direction.

10. The resealable storage bag of claim 6, wherein the closure member is disposed on inner surfaces of the front and back panels immediately below the outwardly curving top edge.

* * * * *